US005400968A

United States Patent [19]

Sood

[11] Patent Number: 5,400,968

[45] Date of Patent: Mar. 28, 1995

[54] INJECTOR TIP COOLING USING FUEL AS THE COOLANT

[75] Inventor: Virendra M. Sood, Encinitas, Calif.

[73] Assignee: Solar Turbines Incorporated, San Diego, Calif.

[21] Appl. No.: 106,735

[22] Filed: Aug. 16, 1993

[51] Int. Cl.[6] ..... F23R 3/28

[52] U.S. Cl. ..... 239/132.5; 239/405

[58] Field of Search ..... 239/132–132.5, 239/403, 405, 406; 60/740, 736, 748, 737, 738

[56] References Cited

U.S. PATENT DOCUMENTS

| | | | |
|---|---|---|---|
| 1,875,457 | 9/1932 | Hemmingsen | 239/132.5 |
| 2,286,658 | 6/1942 | Voit | 239/132.5 |
| 4,088,437 | 5/1978 | Holzapfel | 60/738 |
| 5,121,608 | 6/1992 | Willis et al. | 60/740 |
| 5,218,824 | 6/1993 | Cederwall et al. | 60/748 |

FOREIGN PATENT DOCUMENTS

| | | | |
|---|---|---|---|
| 2022237 | 12/1979 | United Kingdom | 239/132.5 |
| 82/02244 | 7/1982 | WIPO . | |

*Primary Examiner*—Karen B. Merritt
*Attorney, Agent, or Firm*—Larry G. Cain

[57] ABSTRACT

Past systems have attempted to cool the combustor end or tip of fuel injection nozzles by dumping the spent cooling air directly into combustion zone where it can adversely affect the combustion process in general, and NOx and CO emissions in particular. The present system or structure for cooling a combustor end or tip uses a circulating device which in this application is an annular groove positioned in the tip through which fuel is circulated and absorbs heat directly from the tip and indirectly from the combusting gases being produced in the combustion zone. After cooling the tip the fuel exits into a mixing chamber. The mixture of fuel and combustion air is then introduced into the combustion zone, thus, avoiding the direct injection of fuel into the combustion zone. The fuel enters an inlet opening and exits an outlet opening which are positioned about 180 degrees one from the other.

14 Claims, 3 Drawing Sheets

INJECTOR TIP COOLING USING FUEL AS THE COOLANT

DESCRIPTION

1. Technical Field

This invention relates generally to gas turbine engines and more particularly to the unique structural arrangement for cooling the tip of a fuel injection nozzle.

2. Background Art

The use of fossil fuel in gas turbine engines results in high combustion gas temperatures, exceeding 3000 degrees Fahrenheit. The high temperature gas causes overheating of the fuel injection nozzle tip if the tip is not cooled. Overheating of the tip causes it to fail through hot corrosion, carburization, oxidation, cracking, buckling, etc. The fuel injection nozzle tip must, therefore, be cooled to increase the design life of the fuel injectors.

Attempts have been made to cool the nozzle tip and increase the life of such components. One such example of a nozzle, which has attempted to cool the tip thereof, using air, is disclosed in U.S. Pat. No. 4,600,151 issued Jul. 15, 1986 to Jerome R. Bradley. The injector assembly includes a plurality of sleeve means one inside the other in spaced apart relation. For example, an inner air-receiving chamber and an outer air-receiving chamber for receiving and directing compressor discharge air into the fuel spray cone and/or water or auxiliary fuel from the outside for mixing purposes is disclosed. The air streams exit directly into the combustion zone wherein mixing with fuel and combustion occurs.

Another attempt to cool a nozzle is disclosed in U.S. Pat. No. 4,483,137 issued Nov. 20, 1984 to Robie L. Faulkner. This cooling system includes a central air passage and a twofold air flow directed by a secondary air swirl vane and a radially extending swirl vane. Each of the air streams exit directly into the combustion zone wherein mixing with fuel and combustion occurs.

Many of the cooling schemes of the past discharge the spent cooling air into the combustion chamber where it can adversely affect the combustion process. In the invention described herein, fuel is used as a coolant after which it is mixed with incoming combustion air. The premixed fuel and combustion air are then injected into the combustion zone. By avoiding the direct injection of fuel into the combustion zone formation of NOx, CO and particulate emission is minimized.

DISCLOSURE OF THE INVENTION

In one aspect of the invention, a fuel injection nozzle includes a housing having a fuel passage therein. The fuel injector is comprised of a tip attached to the housing. The tip has a combustor end. A fuel circulating means is positioned within the fuel injector nozzle. The fuel circulating means is in communication with the fuel passage and in heat receiving relationship to the combustor end. The fuel circulating means is in communication with an inlet opening and an outlet opening. The inlet opening is positioned a preestablished distance from the outlet opening.

BEST MODE FOR CARRYING OUT THE INVENTION

Figure 1:
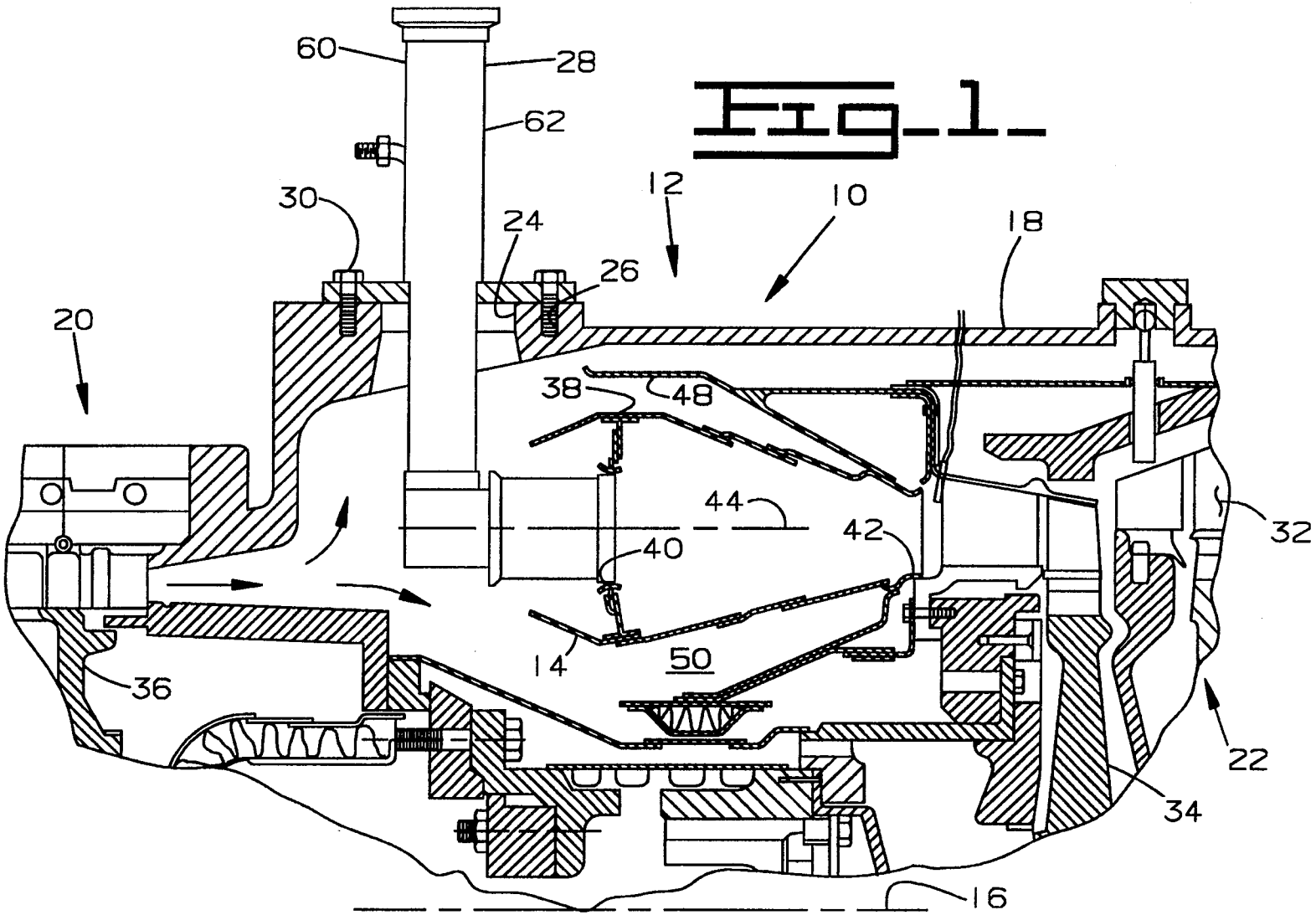
FIG. 1 is a partially sectioned side view of a gas turbine engine having an embodiment of the present invention.

In reference to FIG. 1, a gas turbine engine 10 includes a combustor section 12 having an axial, in line, annular combustor 14 positioned therein. As an alternative to the axial, in line, annular combustor 14, the combustor section 12 could include any type of combustor such as a side mounted combustor or a plurality of can-type combustors without changing the essence of the invention. The gas turbine engine 10 has a central axis 16 and an outer housing 18 coaxially positioned about the central axis 16. The housing 18 is positioned about a compressor section 20 centered about the axis 16 and a turbine section 22 centered about the axis 16. The combustor section 12 is positioned operatively between the compressor section 20 and the turbine section 22. Positioned within the housing 18 intermediate the compressor section 20 and the turbine section 22 is an opening 24 having a plurality of threaded holes 26 positioned therearound. A fuel injection nozzle 28 is conventionally positioned within the opening 24 and attached to the housing 18 by a plurality of bolts 30 engaged in the threaded holes 26. Thus, the fuel injection nozzle 28 is removably attached to the gas turbine engine 10.

The turbine section 22 includes a power turbine 32 having an output shaft, not shown, connected thereto for driving an accessory component such as a generator. Another portion of the turbine section 22 includes a gas producer turbine 34 connected in driving relationship to the compressor section 20. The compressor section 20, in this application, includes an axial staged compressor 36. When the engine 10 is operating, the compressor 36 causes a flow of compressed air to be used for combustion and cooling. As an alternative, the compressor section 20 could include a radial compressor or any source for producing compressed air.

As further shown in FIG. 1, the combustor section 12 includes a multipiece combustor housing 38 having an inlet opening 40 and an outlet opening 42 therein. The combustor housing 38 is supported within the engine 10 in a conventional manner.

Figure 2:
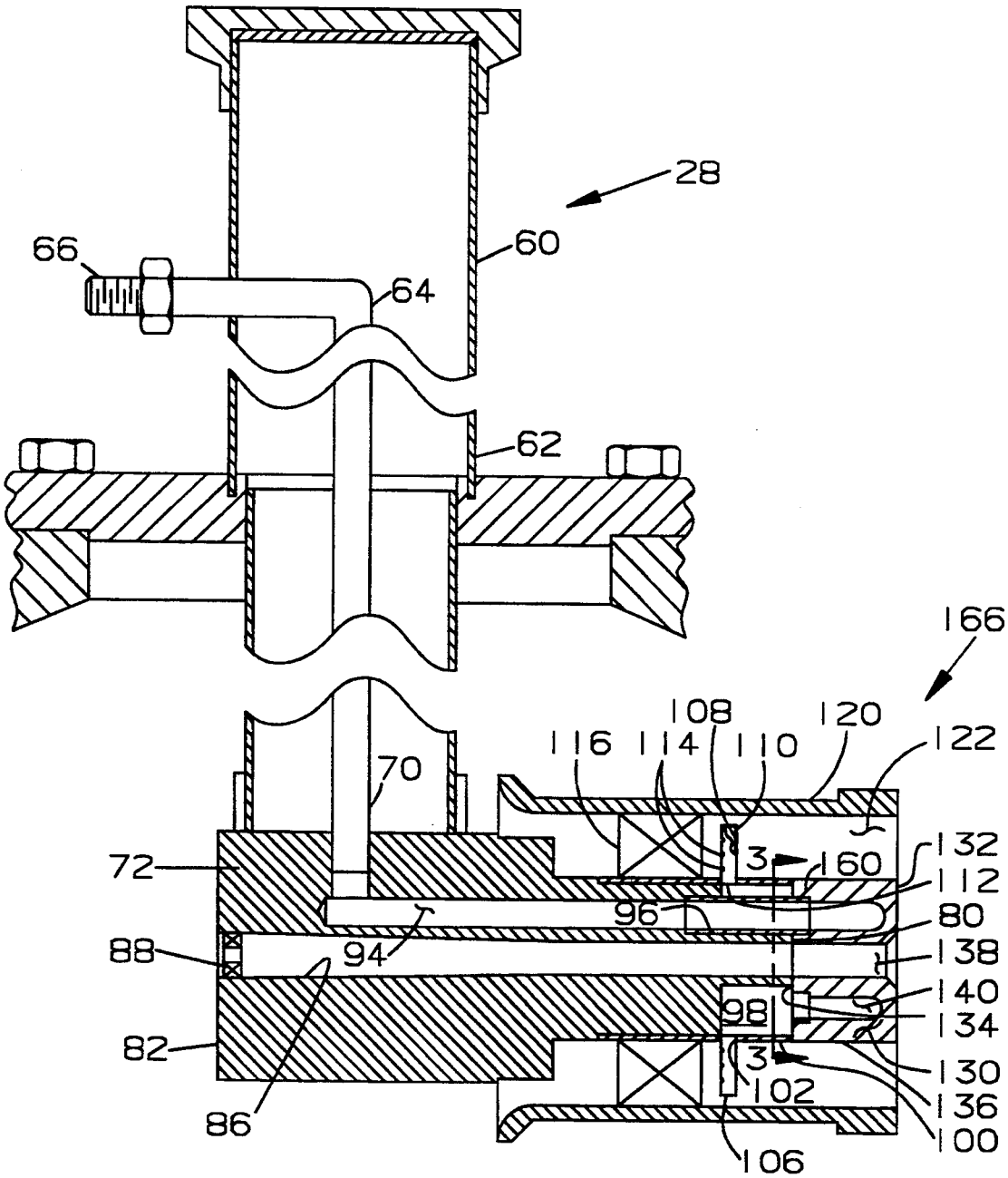
FIG. 2 is an enlarged sectional view of a fuel injection nozzle of FIG. 1.

As best shown in FIG. 2, the fuel injection nozzle 28 includes a support portion 60 having a cylindrical outer shell 62 positioned in the opening 24 within the housing 18. Positioned within the shell 62 is a fuel tube 64 which will be in communication with a supply of gaseous fuel or liquid fuel at an inlet end 66. An outlet end portion 70 of the fuel tube 64 is in communication with a housing 72. The housing 72 has a generally cylindrical configuration and includes a first end 80 and a second end 82. Axially extending through the housing and exiting each of the first and second end portions 80,82 is an air passage 86 having a swirler 88 positioned therein near the second end portion 82.

A fuel passage 94 having an enlarged end 96 extends axially from the first end portion 80 toward the second end portion 82 and communicates with the outlet end portion 70 of the fuel tube 64 intermediate the first end portion 80 and the second end portion 82. The first end portion 80 of the housing 72 has an annular recessed portion 98 therein having a preestablished length and depth. Radially positioned about the housing 72 near the first end portion 80 is a cylindrical cover 100 being sealingly attached to the housing 72 intermediate the first end portion 80 and the second end portion 82. A series of holes or fuel outlets 102 are radially disposed in the cylindrical cover 100 and align with the annular recessed portion 98. A plurality of spokes 106 are sealingly positioned in corresponding ones of the plurality of holes 102. Each of the plurality of spokes 106 have a generally cylindrical configuration, an inner passage 108, a closed end 110 and an open end 112. Axially interposed the closed end 110 and the open end 112 is a plurality of openings 114. A swirler 116 is radially evenly disposed about the cylindrical cover 100 and is attached thereto. Radially spaced from the cylindrical cover 100 and the housing 72 a preestablished distance and attached to the swirler 116 is a shield 120 having a generally cylindrical configuration. A mixing chamber 122 is formed between the shield 120 and the cover 100. The closed end 110 of each of the plurality of spokes 106 are spaced from the shield 120 a preestablished distance.

Figure 3:
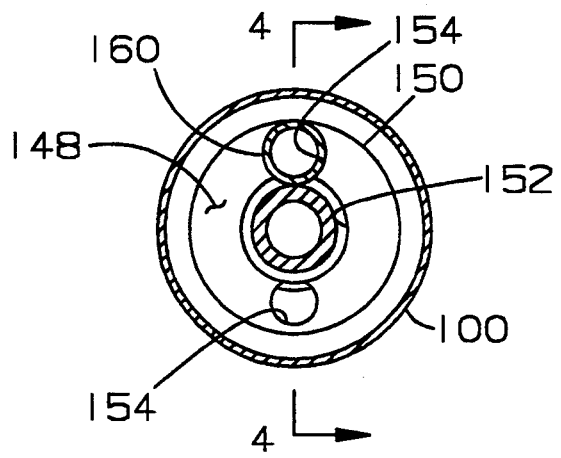
FIG. 3 is an enlarged sectional view of a tip of the fuel injection nozzle taken along lines 3—3 of FIG. 2.
Figure 4:
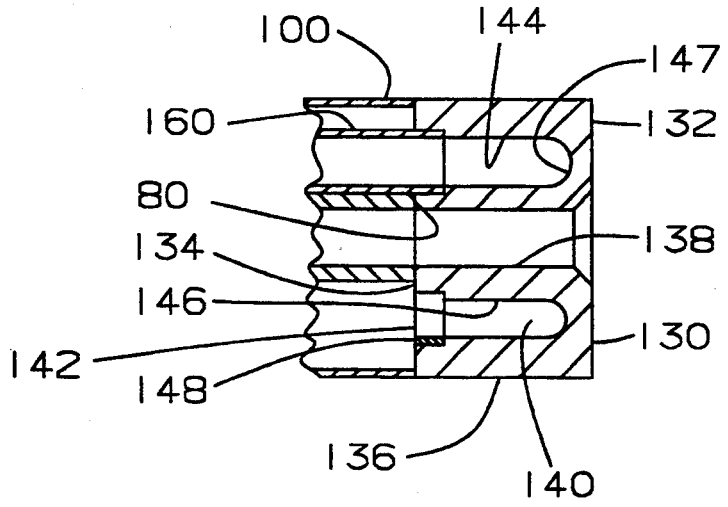
FIG. 4 is an enlarged sectional view of the tip of the fuel injection nozzle taken along lines 4—4 of FIG. 3.

As best shown in FIGS. 2, 3, and 4, attached to the housing 72 at the first end portion 80 is a tip or cap 130 having a combustor end 132, a housing end 134 and a generally cylindrical outer surface 136 formed thereon. A central passage 138 extends axially from the combustor end 132 to the housing end 134 and is axially aligned with the air passage 86. An annular groove 140 extends axially from the housing end 134 toward the combustor end 132 and is positioned radially between the central passage 138 and the outer surface 136. The annular groove 140 is spaced from the combustor end 132 a preestablished axial distance so that the annular groove 140 is in heat conducting relationship to the combustor end 132. The preestablished axial distance, in this application, is between about 4 mm and 6 mm in length. This length will vary depending on the type of material used to make the tip 130, the heat absorbing characteristics of the fuel used to cool the combustor end 132, the thermodynamic state of the combustion zone gases, etc.. The combustor end 132 further has an area of combustion surface which is defined by the area within the cylindrical outer surface 136 less the air passage 86. In this application, the area of combustion surface is equal to about 1370 square mm. The annular groove 140 has an enlarged end portion 142. The annular groove 140 defines an outer surface 144 and an inner surface 146 between which is defined an area 147 in which the fuel is in heat absorbing relationship to the combustor end 132. In this application, the area of heat absorbing relationship is equal to about 450 square mm. Thus, a ratio of about 1 to 3 of heat absorbing area to combustion surface area is needed to cool the tip 130 of the fuel injection nozzle 28.

A plate 148, best shown in FIGS. 3 and 4, having a generally washer configuration includes an outer portion 150, an inner portion 152 and a pair of bores 154 therein. The pair of bores 154 are positioned a preestablished distance one from the other. One of the pair of bores 154 is an inlet opening and the other of the pair of bores 154 is an outlet opening. For example, in this application, since the inlet opening and the outlet opening are positioned about the annular groove 140 the openings are positioned 180 degrees one from the other to insure the most efficient circulation of the cooling media. The plate 148 is positioned in the enlarged end portion 142 of the annular groove 140 near the housing end 134 having the outer portion 150 sealingly engaged therein and the inner portion 152 sealingly engaged therein. A cylindrical tube 160 has an end sealingly positioned in a portion of one of the pair of holes 154 and a portion of the tip 130, and the other end is sealingly positioned in the enlarged end 96 of the fuel passage 94. A circulating means 166 includes the annular groove 140 and the plate 148. The circulating means 166 is in fluid communication with the pair of holes 154 which make up the inlet opening and the outlet opening.

Depending on the type of fuel to be used, gaseous or liquid, some minor changes will be required to accommodate the differences in the flow characteristics of the gaseous fuel versus the liquid fuel. For example, some of these changes would include the size of the passage 94 in the housing 72, the size of the annular groove 140, the inner passage 108 within each of the spokes 106 and the plurality of openings 114 in the spokes. With these changes either a gaseous or liquid fuel can be used to cool the tip 130 of the injection nozzle 28.

Industrial Applicability

In operation, the gas turbine engine 10 is started in a conventional manner. As the engine 10 increases in speed and load demand from the driven device increases, more fuel is introduced to provide more power. For example, when the engine 10 is using only gaseous fuel, the cool gaseous fuel enters through the gaseous fuel tube 64 and passes into the gaseous fuel passage 94. From the passage 94, the gaseous fuel passes through the cylindrical tube 160 into the annular groove 140 in the tip 130 of the fuel injection nozzle 28. The cool gaseous fuel circulates in the annular groove 140 of the tip 130 and exits the one of the pair of holes 154 opposite the one of the pair of holes 154 it entered and passes into the space defined by the annular recessed portion 98, the plate 148, the tip 130 and the cover 100. The gaseous fuel enters into the inner passage 108 of the plurality of spokes 106 and exits through the plurality of openings 114 into the mixing chamber 122. The heated fuel mixes with the combustion air in the mixing chamber 122 prior to entering into the annular combustor; wherein, it burns and drives the turbine section 22. The hot gases of combustion come in contact with the combustor face 132 of the tip 130 and attempt to cause hot corrosion, carburization, oxidation, cracking, buckling, etc. and destroy the combustor face 132. Since the gaseous fuel circulates in the annular groove 140, and the annular groove 140 is in heat receiving relationship with the combustor face 132, the combustor face 132 is cooled which prevents or reduces the effects of hot corrosion, carburization, oxidation and erosion on the fuel injector nozzle 28. The feature of the fuel entering the annular groove 140 through one of the pair of holes 154 and exiting the other of the pair of holes 154, which is positioned 180 degrees apart, insures that the fuel circulates through the annular groove 140 and is continuously replenished by new cooler fuel prior to mixing with combustion air and entering the combustion zone.

When a liquid fuel is used, the functional operation as described above is identical and the tip 130 is cooled by the liquid fuel. As stated above, the sizing of the passages due to the characteristics of the fuel flow may need to be changed.

In view of the foregoing, it is readily apparent that the structure of the present invention provides an improved method and structure for cooling the tip 130 of a fuel injector nozzle 28. The structure and unique circulation of the cool fuel through the annular groove 140 absorbing heat from the combustor end 132 increases the life of the combustor nozzle 28. The cooling structure is adaptable to both gaseous and liquid fuel and can be utilized in any application where a fuel injector is required such as gas turbine engines, furnaces, home appliances and boilers.

Other aspects, objects and advantages of this invention can be obtained from a study of the drawings, the disclosure and the appended claims.

I claim:

1. A fuel injection nozzle including a housing having a fuel passage therein, said fuel injection nozzle comprising:

a tip attached to the housing, said tip having a combustor end;

a fuel circulating means positioned within the fuel injection nozzle and being in communication with the fuel passage, said fuel circulating means being in heat receiving relationship to the combustor end and including an annular groove;

said fuel circulating means being in communication with an inlet opening and an outlet opening;

said inlet opening being positioned 180 degrees from said outlet opening; and wherein during operation a fuel is circulated progressively through said fuel passage, said inlet opening, said annular groove, said outlet opening and being mixed with a combustion air and entering a combustion zone.

2. The fuel injector nozzle of claim 1 wherein said combustor end of the tip defines a combustion surface area and said annular groove defines a heat absorbing area and said heat absorbing area has a ratio to said combustion surface area.

3. The fuel injector nozzle of claim 2 wherein said ratio of the heat absorbing area to combustion surface area is about 1 to 3.

4. The fuel injector nozzle of claim 1 wherein said combustor end is axially spaced from said fuel circulating means a preestablished distance.

5. The fuel injector nozzle of claim 4 wherein said preestablished distance is in the range of about 4 mm to 6 mm.

6. The fuel injector nozzle of claim 5 wherein said preestablished distance is equal to 5 mm.

7. The fuel injector nozzle of claim 1 wherein during operation of said fuel injector nozzle a flow of gaseous fuel is circulated through said circulating means.

8. The fuel injector nozzle of claim 1 wherein during operation of said fuel injector nozzle a flow of liquid fuel is circulated through said circulating means.

9. The fuel injector nozzle of claim 1 wherein said housing includes a first end portion near which during operation a flow of fuel is introduced into the housing and a second end portion to which said tip is attached.

10. The fuel injector nozzle of claim 9 wherein said fuel injector nozzle further includes a series of fuel outlets axially interposed the introduction of the flow of fuel and the tip.

11. The fuel injector nozzle of claim 1 further including a mixing chamber and during operation of said fuel injector nozzle a fuel after exiting the circulating means and having been in heat receiving relationship to the combustor end exits into the mixing chamber.

12. The fuel injector nozzle of claim 1 wherein said housing includes a first end portion and a second end portion to which said tip is attached, a series of outlets axially interposed said first end portion and said second end portion.

13. The fuel injector nozzle of claim 1 further including a mixing chamber positioned radially about the housing and the tip, said mixing chamber having a series of fuel outlets entering therein and an exit end generally axially aligned with the combustor end, said circulating means being interposed the combustor end and the series of fuel outlets.

14. The fuel injector nozzle of claim 1 wherein said fuel circulating means is positioned within the tip.

* * * * *